United States Patent [19]

Arakawa et al.

[11] Patent Number: 4,768,458

[45] Date of Patent: Sep. 6, 1988

[54] METHOD OF PRODUCING THIN METAL RIBBON

[75] Inventors: Shunsuke Arakawa, Saitama; Yoshizo Sawada, Kawamoto, both of Japan

[73] Assignee: Hitachi, Metals Inc., Tokyo, Japan

[21] Appl. No.: 108,621

[22] Filed: Oct. 15, 1987

Related U.S. Application Data

[63] Continuation of Ser. No. 807,685, Dec. 11, 1985, abandoned.

[30] Foreign Application Priority Data

Dec. 28, 1985 [JP] Japan ..... 60-279856

[51] Int. Cl.[4] ..... B22D 11/06

[52] U.S. Cl. ..... 164/463; 164/479; 164/423

[58] Field of Search ..... 164/463, 479, 423, 429

[56] References Cited

U.S. PATENT DOCUMENTS

| | | | |
|---|---|---|---|
| 4,221,257 | 9/1980 | Narasimhan | 164/463 |
| 4,386,648 | 6/1983 | Hilzinger et al. | 164/463 |
| 4,479,528 | 10/1984 | Maringer | 164/423 |

*Primary Examiner*—Kuang Y. Lin

*Attorney, Agent, or Firm*—Antonelli, Terry & Wands

[57] ABSTRACT

A method of manufacturing an amorphous metal sheet or ribbon which comprises extruding a molten metal from an orifice of a nozzle and directing the extruded molten metal onto a moving chill surface to rapidly cool and solidify the metal thereby forming said sheet or ribbon; said orifice being a rectangular slit defined by side walls and a front lip and a back lip arranged in front and behind the slit in the direction of movement of the chill surface below said nozzle; said chill surface moving a speed of 10 m/sec to 50 m/sec and being spaced from the front lip by a gap length of from 100 μm to 600 μm and the width $W_F$ of the front lip measured in the direction of movement of the chill surface being represented by the relationship $W_F \leqq W$, wherein W represent the width the slot in the nozzle.

5 Claims, 2 Drawing Sheets

METHOD OF PRODUCING THIN METAL RIBBON

This is a continuation of application Ser. No. 807,685, filed Dec. 11, 1985, and now abandoned.

BACKGROUND OF THE INVENTION

The present invention relates to a method of producing a thin metal sheet or ribbon and, more specifically, to a method of extruding or ejecting a molten metal melt from a rectangularly shaped orifice onto a moving cooling surface adjacent to the orifice so that the melt is rapidly cooled by the cooling surface to provide a thin metal sheet or ribbon, particularly a thin amorphous metal ribbon. The melt extruded from the orifice is spread and rapidly cooled to a thin metal ribbon on the moving surface.

Thin amrphous metal ribbons having a width of more than 100 mm are currently manufactured in Japan. The manufacturing process now employed is based on the process which was pioneered by researchers in Tohoku University and the Research Institute of Electric and Magnetic Alloys(RIMEA) in Sendai, Japan.

Previously, a manufacturing process for thin ribbons formed of amorphous metal which employed a rapid quenching apparatus provided with a cooling roll and a slotted nozzle was demonstrated in an exhibition room in a new RIEMA building to celebrate the completion of the new building on July 8, 1976. The manufacturing process was similar to the process disclosed in U.S. Pat. No. 905,758 issued on Dec. 1, 1908 to E. H. Strange, et al. or U.S. Pat. No. 3,605,863 issued on Sept. 20, 1971 to Derek King. In the demonstration, ribbons of about 8 mm width made of amorphous metal having a clean surface were produced by this manufacturing process. Tohoku Broadcasting Company reported the demonstration in a T.V. program, "Kahoku Sinpo News" which started at 11:20 p.m. on July 8, 1971 and at 7:10 a.m. on July 9, 1971, in the area including Sendai-City.

In the demonstration, the following experimental conditions were used to make the wide amorphous metal ribbons having a thin thickness. The rapid quenching apparatus was equipped with a slotted nozzle having an orifice with a rectangular shape. The gap length between the orifice and the cooling roll surface was about 0.4 mm, the slit width of the slot was about 0.4 mm, each of the lips defining the orifice had a width of about 1 mm measured in the moving direction of the chill surface. About two years later, a similar process for forming an amorphous metal ribbon was desclosed in Narashimhan's Japanese Laid-Open Patent Application 53-53525 on May 16, 1978 in Japan. In both processes, i.e., the demonstrated process at RIEMA and the Narashimhan process, molten metal is extruded from an orifice defined between a back lip, a front lip and side walls through a slot formed in a nozzle in a form of a melt stream onto a rotating roll surface to form a thin amorphous metal ribbon.

However, in the above-mentioned processes, there were drawbacks that the prduced amorphous metal ribbon, especially a ribbon having a thickness of about 25 μm or less might be provided with scratches on the surface or with a rough surface.

SUMMARY OF THE INVENTION

Accordingly, it is an object of this invention to remove the drawbacks of this prior art and to provide a method of manufacturing an amorphous alloy sheet or ribbon having an excellent surface without scratches.

It is another object of this invention to provide a method of manufacturing an amorphous metal sheet or ribbon having a smooth surface.

This invention is directed to a method of manufacturing an amorphous metal sheet or ribbon by a rapid cooling of a molten metal on a moving chill surface wherein the molten metal is directed onto the surface and wherein:

(a) the molten metal is extruded from a nozzle through a rectangular orifice slit surrounded by a back lip, a front lip and side walls onto the moving chill surface;

(b) the chill surface is moving at a speed of 10 m/sec to 50 m/sec;

(c) the gap length between the chill surface and the front lip is between 100 μm to 600 μm; and (d) the width $W_F$ of the front lip measured in a direction of travel of the chill surface satisfies the relationship $W_F \leqq W$, wherein W represents the width of the slit in the nozzle.

BRIEF DESCRIPTION OF THE DRAWINGS

The invention will be further understood from the following detailed description and the accompanying drawings wherein.

DETAILED DESCRIPTION OF THE PREFERRED EMBODIMENTS

Figure 4:
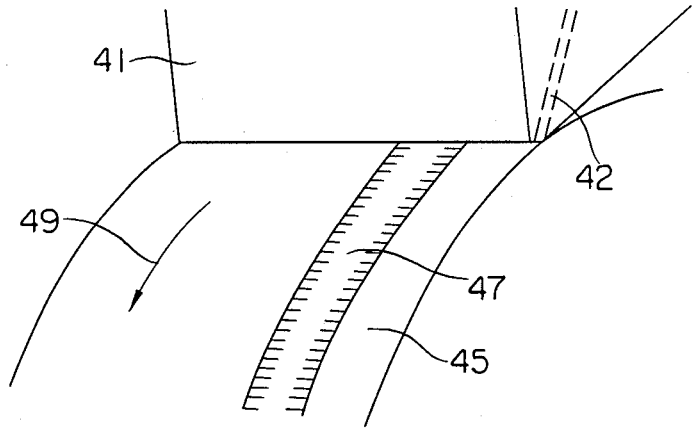
FIG. 4 is a somewhat simplified perspective view of the solidification of a molten metal ejected onto a roll surface in accordance with the present invention.

In FIG. 4 solidification of a molten metal on the chill surface of a moving roll is shown in a perspective view. The moving speed of the roll surface 45 should be 10 m/sec to 50 m/sec to produce a metal sheet 47 in an amorphous state. The gap length or space between the roll surface 45 and the front lip of the nozzle 41 should be 100 μm to 600 μm. If the gap length is less than 100 μm, a small deviation of the roll axis or some slags adhered on the front lip causes a bad effect on the surface condition of the metal sheet to be produced which has generally a thickness of 10 μm to 50 μm.

On the contrary, if the gap length is larger than 600 μm, a waving of the top surface (ribbon surface on the opposite side to the ribbon surface contacting with the roll surface) will be produced.

The ratio $W_F/W$ of the front lip width $W_F$ to the slit width W is an especially important factor in the process. In a previous process disclosed in U.S. Pat. No. 4,221,257 which corresponds to the Japanese Laid-open Patent Application 53-53525, the front lip was provided with a rather wide width $W_F$ which satisfies the relationship: $1.5 \leqq W_F/W \leqq 3.0$ where W represents the slit width of the orifice at the end of the slot in the nozzle.

However, in the previous process, an upper surface of a metal puddle formed between the chill surface and the front lip is pressed by the lower surface of the front lip, and this causes bad conditions for the top surface of the metal sheet to be produced. In the present invention, the restriction of the front lip width $W_F$ as $W_F/W \leqq 0.8$ makes the upper surface of the melt puddle rather free and makes the surface conditions of the metal sheet excellent. The top surface roughness Rz (by JIS BO 601-1970) can be improved. Especially the improvement of top surface conditions for a rather thin metal ribbon having a thickness of 25 μm or less is remarkable. Because the width restriction as established by the relationship $W_F/W < 0.1$ makes the front lip brittle, the width $W_F$ should be a value which satisfies the relationship $W_F/W \geqq 0.1$. An inclination of the slot or passage leading to the orifice from the perpendicular direction of the chill surface is preferable, because the freedom of the upper surface of the metal puddle can be increased. The angle between the moving direction of the chill surface and the surface vector of the slot is about 10° to 70°, especially an angle of about 20° is preferable to make the top surface of the metal sheet smooth. The surface vector is a vector which is normal to the surface of the slot. Under the conditions satisfying $0.1W \leqq W_F \leqq 0.8W$, amorphous metal ribbons having a small surface roughness (Rz) without scratches are obtained.

Figure 1:
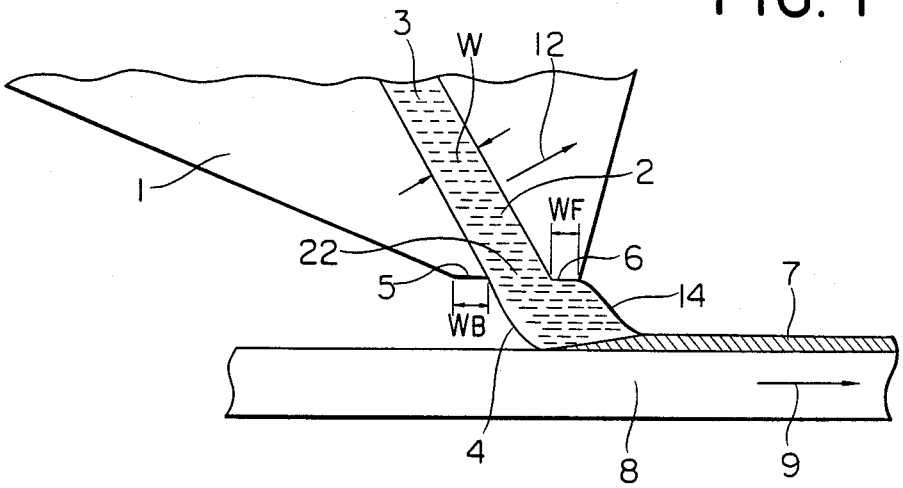
FIG. 1 is a side view, in partial cross section, illustrating the solidification of a molten metal extruded onto a roll surface from a nozzle in accordance with the present invention.

FIG. 1 shows, in partial cross section, a side view illustrating the method of the present invention. As shown in FIG. 1. a chill surface 8, here illustrated as a surface of a belt 8, moves in the direction of the arrow 9. Metal melt 4 is ejected or extruded from an orifice 22 defined by a front lip 6, a back lip 5 and side walls (not shown in the figure) onto the chill surface 8. The molten metal discharged from the orifice 22 can be spread in the moving direction 9 of the chill surface and solidified on the chill surface to become an amorphous strip. The solidified part 7 is seen at the bottom of the melt puddle 4 and at the part of the melt pulled out from the puddle. The back lip 5 has almost no effect to the melt puddle 4.

It can be observed that the front lip 6 might contact by a wetting phenomenon with the upper surface 14 of the melt-puddle 4, but it scarcely presses or contacts the melt puddle. In this example, the surface vector 12 of the slot 2 angles with the vector of the moving direction of the chill surface about 20°. The surface vector 12, as shown in FIG. 1, is a vector normal to the surface of the slot.

The chill surface moves at a velocity of about 10 m/sec to 50 m/sec. Generally the thickness (g) of an amorphous metal ribbon to be produced by this process ranges about 10 μm to 50 μm. The gap lenghth G between the front lip and the chill surface is about 3 to 20 times of the ribbon thickness g and the width of the slit W in the nozzle is about 0.33 mm to 0.9 mm. It is sufficient for the width WB of the back lip to be 0.1 to 0.8 times of the slit width W. The puddle is formed as a melt droplet because of a low viscosity and a high surface tension of the melt and the part of the melt contacting the chill surface is solidified to become a thin ribbon.

Figure 2:
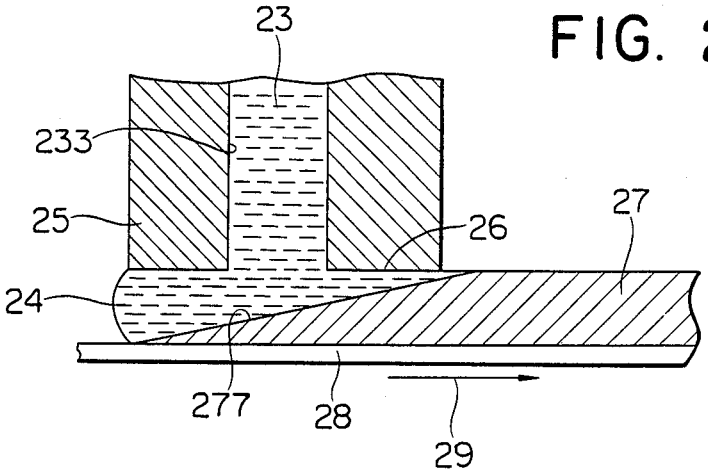
FIG. 2. is a cross-sectional view illustrating the imaginary solidification of a molten metal on a roll surface in accordance with the method disclosed in U.S. Pat. No. 4,221,257.
Figure 3:
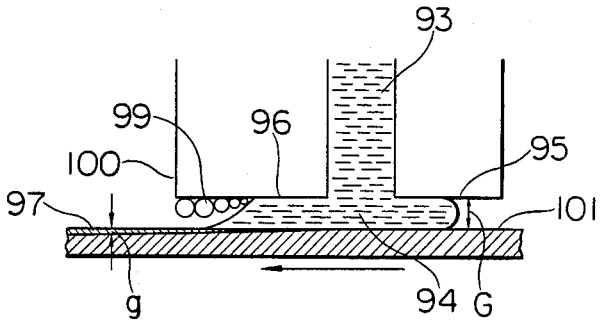
FIG. 3.is a cross-sectional view illustrating the actual solidification of a molten metal on a roll surface in accordance with U.S. Pat. No. 4,221,257.

FIG. 2 of the drawings provides a side view, in partial cross section, illustrating formation of a strip from molten metal deposited onto a moving chill surface from a nozzle in accordance with the prior art disclosed in Japanese Laid-Open Patent Application No. 53-53525 (which is corresponding to U.S. Pat. No. 4,221,457). In this prior art process the back lip 25 supports the molten metal by a pumping action of the melt which results from constant removal of solidified strip 27. The solidification front barely missed the end of the front lip. Above the solidification front a body of molten metal is maintained. As shown in the figure, the thickness of the amorphous metal ribbon to be produced is almost equal to the gap length between the chill surface and the front lip. The widths W, $W_B$ and $W_F$ measured in a moving direction of the chill surface of the slot 233, the back lip and the front lip, respectively, satisfies relationships $1.5 \leqq W_F \leqq 3W$, and $W_B \geqq W$. In this process the lips 25 and 26 presses the melt puddle 25 to the chill surface to obtain a metal ribbon steadily.

It is described in the example in the Japanese Laid-Open Patent Application No. 53-53525 that an amorphous metal ribbon was obtained having an alloy composition of $Fe_{40}Ni_{40}P_{14}B_6$ provided with a thickness of 0.05 mm from a melt maintained between the lips and the chill surface where the gap length between the front lip and the chill surface was 0.05 mm.

In the prior art process a nozzle with a wide front lip, a wide back lip compared with the slit width of an orifice is employed. This process is termed "planar flow casting" in the patent application. Actually, it has been determined by further investigation in our laboratory that the gap length G between a chill surface 101 and a front lip 96 is preferably larger by at least 6 times than the ribbon thickness g. For example, the gap length between the front lip and the chill surface is preferably about 0.3 mm in the case that an amorphous metal ribbon has a thickness of 0.05 mm. In this process there is a space between the bottom surface of the wide front lip and the chill surface where slags 100 and small metal droplets 99 are attached. These slags of droplets tend to cause scratches or defects corresponding to these slags and droplets on the top surface of amorphous metal ribbon or other bad effects on the ribbon surface. Sometimes a nozzle break is produced by the droplets which enter into a space between a roll surface and a nozzle tip in the provious process. Scratches reflecting the uneven height observed in a perpendicular direction to the chill moving direction due to slags adhered to the front lip are produced and are found to extend in a longitudinal direction of the ribbon on the top surface of a ribbon. The formation probability of scratches increases remarkably as a ribbon to be produced is made thinner, because a height of a melt puddle becomes larger compared with the ribbon thickness. It was further determined that the width $W_F$ of the front lip bottom measured in a chill surface moving direction should be smaller than the slit width W of a slot in a nozzle, especially $W_F$ should be smaller than W by less than 0.8 times in order to prevent scratches on a top surface of a metal ribbon. In a process according to the present invention, no droplets are produces at the bottom of the front lip.

The following are examples of the present invention.

EXAMPLE 1

The surface roughness (Rz) of amorphous metal ribbons having a 20 mm width produced by the present invention were measured and the process was set under the following conditions:

Gap length between the front lip and the chill surface: 0.13 mm,

Angle between the direction vector of roll surface movement and the surface vector of the slot: about 20°, Slit width of the slot: 0.63 mm, Width of the back lip: 1.8 mm.

Figure 5:
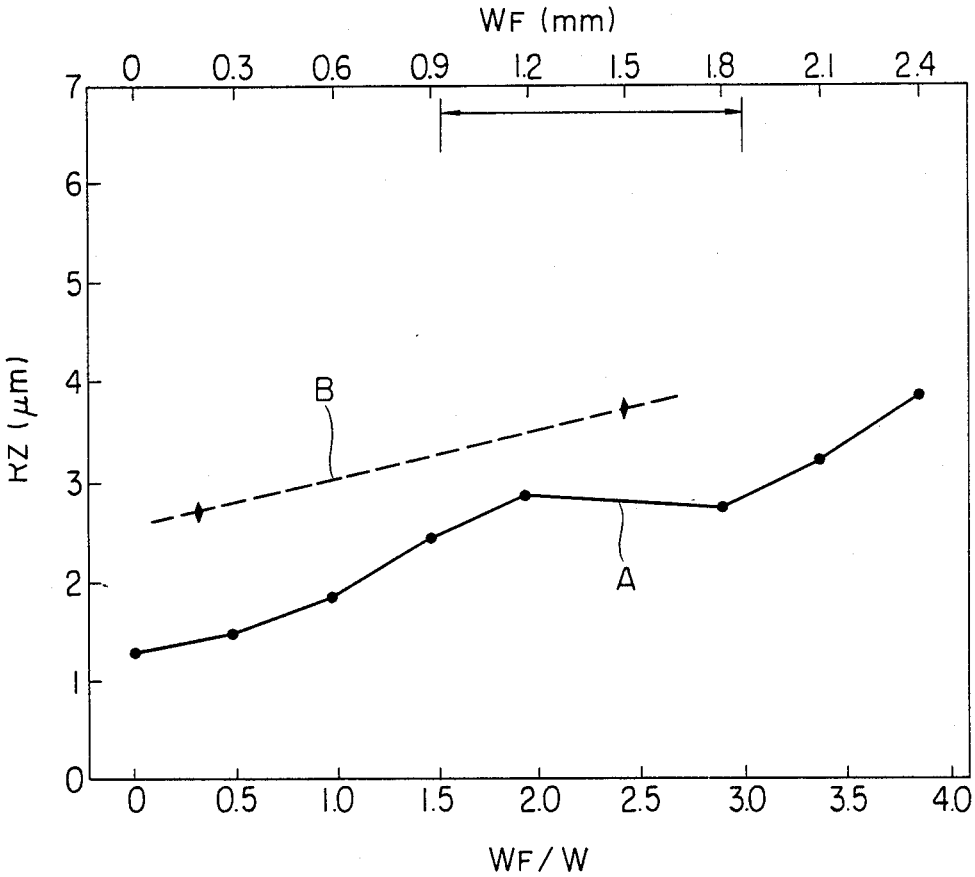
FIG. 5 is a graph showing the surface roughness ($R_z$) dependence on the ratio ($W_F/W$) of the front lip width ($W_F$) to the slit width (W), where the curve A shows the experimental result using a nozzle which has a slit with a width of 0.63 mm and a back lip with a width of about 1.8 mm and which was spaced from the chill surface by 0.13 mm, and the curve B shows the experimental result using a nozzle having a slit with a width of 0.62 mm and a back lip with a width of about 0.2 mm.

The surface roughness of an amorphous metal ribbon having a width of 20 mm was measured. The experimental results are shown by the curve A in FIG. 5. As shown in this figure, the top surface roughness (Rz: JIS BO60-1970) becomes smaller as the ratio $W_F/W$ becomes smaller than 1.5. The lip widths were measured in the moving direction of the chill surface.

EXAMPLE 2

In order to investigate the technical effects of the present invention, another experiment to produce an amorphous metal ribbon was performed under the following condition:

Gap length between the chill surface and the front lip: 0.2 mm,

Angle between the direction vector to roll surface movement and the surface vector of the slot: about 20°, Slit width of the slot: 0.62 mm, Width of the back lip: 0.2 mm, Width of the front lip: 0.2 mm.

The width of amorphous metal ribbons produced in this example was about 40 mm. The experimental results are shown by the curve B in FIG. 5. Although Rz is about 3.7 μm when $W_F/W$ equals about 2.5, Rz is about 2.7 μm when $W_F/W$ equals about 0.35.

EXAMPLE 3

Amorphous metal ribbons were produced by a similar procedure as described in Example 2 according to the present invention. For a comparison a process described in U.S. Pat. No. 4,221,257 was conducted in which the lips surrounding the slit are rather wide as measured in a direction of movement of the chill surface. The operation was recorded on motion picture film and it was found that a great deal of slag adhered to the lip wall and some melt droplets adhered to the bottom surface of the lip. To the contrary, in the process in accordance with the present invention, there were no slag formations adhered to the lip wall or no droplets adhered to the bottom surface of the lip. The present process according to this invention can be called as "beaky nozzle process".

EXAMPLE 4

Another run was conducted to produce an amorphous metal ribbon in a similar manner as in Example 2. The following different experimental conditions were employed:

Gap length between the nozzle lips and the chill surface: about 0.3 mm,

Ribbon thickness: about 18 μm

In this run, amorphous metal ribbons were produced with no scratches and no solidified droplets on the top surface. There occurs no breakage of the nozzle during a casting or after a casting.

What is claimed:

1. A method of manufacturing an amorphous metal sheet having a thickness of less than 30 μm which comprises extruding a molten metal from an orifice of a slot defined by a pair of side walls and a pair of lips and making a stream of the molten metal from the orifice onto a moving chill surface to rapidly cool and solidify the metal thereby forming said amorphous metal sheet, wherein the stream of the molten metal is extruded to be advanced toward the moving direction of the chill surface and the upper surface of the stream of the molten metal extends beyond a front lip of the pair of lips arranged downstream of the slot in the direction of metal movement and sweeps the front lip under the following conditions; said orifice being a rectangular slit, said front lip being flat and a back lip of the pair of lips arranged upstream of the slot in the direction of metal movement being flat; said chill surface moving at a speed of 10m/sec to 50m/sec and being spaced from the front lip by a gap length of from 100 μm to 600 μm and the width $W_F$ of the front lip measured in the direction of movement of the chill surface being represented by the relationship $W_F/W \leqq 0.8$ wherein W, representing the width of a slot in the nozzle, has a value of 0.3 mm to 0.9 mm, the slot formed in the nozzle is inclined to make an angle such that the molten metal is extruded in the same direction as the moving direction of the chill surface, and the gap length G between the chill surface and the tip of the front lip satisfies an inequality:

$$3\,g \leqq G \leqq 20\,g$$

where g represents a thickness of the formed metal sheet.

2. A method according to claim 1, wherein the surface vector of the slot which is normal to the slot surface makes an angle of about 20 degrees with the moving direction vector of the chill surface.

3. A method according to claim 1, wherein $W_F$ satisfies an inequality:

$$0.1\,W \leqq W_F \leqq 0.5\,W.$$

4. A method according to claim 1, wherein the width $W_B$ of the back lip satisfies an inequality:

$$0.1\,W \leqq W_B \leqq 0.8W.$$

5. A method according to claim 1, wherein the back lip is substantially free of contact with the stream of the molten metal and the front lip contacts a minor portion of the upper surface of the stream; a major portion of the upper surface being free from the front lip.

* * * * *